United States Patent [19]

Daniels et al.

[11] 4,206,319

[45] Jun. 3, 1980

[54] TUNE DELAY SCRAMBLE EQUIPMENT

[75] Inventors: Howard L. Daniels, St. Paul, Minn.; Walter L. Anderson, Falls Church, Va.; Robert R. Reisinger, Mahtomedi, Minn.

[73] Assignee: The United States of America as represented by the Secretary of the Navy, Washington, D.C.

[21] Appl. No.: 405,270

[22] Filed: Jan. 20, 1954

[51] Int. Cl.[2] ..... H04K 1/06

[52] U.S. Cl. ..... 179/1.5 C; 179/1.5 R

[58] Field of Search ..... 35/2, 4; 179/1.5, 1.5 R, 179/1.5 G, 1.5 S, 1.5 C; 178/5.1, 22, 52; 340/350, 364, 365

[56] References Cited

U.S. PATENT DOCUMENTS

| | | | |
|---|---|---|---|
| 2,364,210 | 11/1944 | Guanella | 179/1.5 R |
| 2,406,347 | 8/1946 | Buhrendorf | 179/1.5 C |
| 2,406,348 | 8/1946 | Buhrendorf | 179/1.5 C |
| 2,531,435 | 11/1950 | Hoth | 179/1.5 R |
| 2,539,556 | 1/1951 | Steinberg | 179/1.5 C |
| 2,632,057 | 3/1953 | Koenig, Jr. | 179/1.5 C |
| 3,937,888 | 2/1976 | Myers | 179/1.5 C |

FOREIGN PATENT DOCUMENTS

| | | | |
|---|---|---|---|
| 579194 | 7/1946 | United Kingdom | 179/1.5 R |

*Primary Examiner*—Howard A. Birmiel

*Attorney, Agent, or Firm*—Richard S. Sciascia; Arthur A. McGill; Prithvi C. Lall

EXEMPLARY CLAIM

1. A time-delay scramble equipment comprising, a drive motor, a combined input commutator element and brush element, one of said input elements being mechanically coupled to said motor, said input commutator element having a predetermined number of conducting segments, a magnetic recording drum mechanically coupled to said drive motor, said recording drum including two attached sections for rotation together, each section of said recording drum having a plurality of axially spaced recording tracks, the number of tracks on each section of said recording drum being one-half of said predetermined number of input commutator segments, a plurality of aligned record-pickup heads, the number of record-pickup heads being equal to the number of recording tracks on said recording drum, one of said record-pickup heads being disposed at each recording track, electrical means connecting in sequence said input commutator element segments to respective ones of said record-pickup heads, a corresponding plurality of aligned erase heads one at each track and angularly spaced 180 degrees from said record-pickup heads, an erase supply, a combined erase commutator element and brush element, one of said erase elements being mechanically coupled to said motor, said erase brush element being connected to said erase supply, said erase commutator element having two conducting segments disposed diametrically apart, each of the segments of said erase commutator being electrically connected to all of the erase headsassociated with a respective recording drum section, a cross-wired wheel for each recording drum section, each of said cross-wired wheels having the same number of connections as there are record-pickup heads associated with the respective recording drum section, electrical means connecting the record-pickup heads associated with each recording drum section with a corresponding cross-wired wheel, a combined output commutator element and brush element, one of said output elements being mechanically coupled said motor, said output commutator element comprising two adjacent arcuate sections, each section having a number of segments comprising twice the number of connections of each of said cross-wired wheels, electrical means connecting each cross-wired wheel to a respective section of said output commutator with each connection of each cross-wired wheel being connected to two output commutator segments that are an even number of segments apart, said motor driving each of said elements mechanically coupled thereto at the same angular velocity, a positioner wheel mechanically coupled to each of said cross-wired wheels, each of, said positioner wheels including a conducting ring formed with a single interruption, a plurality of brushes for each positioner wheel equal to the number of connections in each cross-wired wheel and spaced at angular intervals about said rings respectively, a positioner supply, a positioner wheel motor connected in series between said positioner supply and said rings and mechanically coupled to said positioner wheels, relay switch means for each of said positioner wheels, each of said relay switch means electrically coupled to the brushes of the respective positioner wheel and to said positioner supply for connecting one brush associated with each positioner wheel to said positioner supply and a random binary pattern generator coupled to said relay switch means for controlling the operation of said relay switch means to select at random for energization the one brush associated with each of said positioner wheels for controlling random angular positioning of the respective cross-wired wheels.

6 Claims, 4 Drawing Figures

SCRAMBLED OUTPUT

Figures 1, 2, 3:
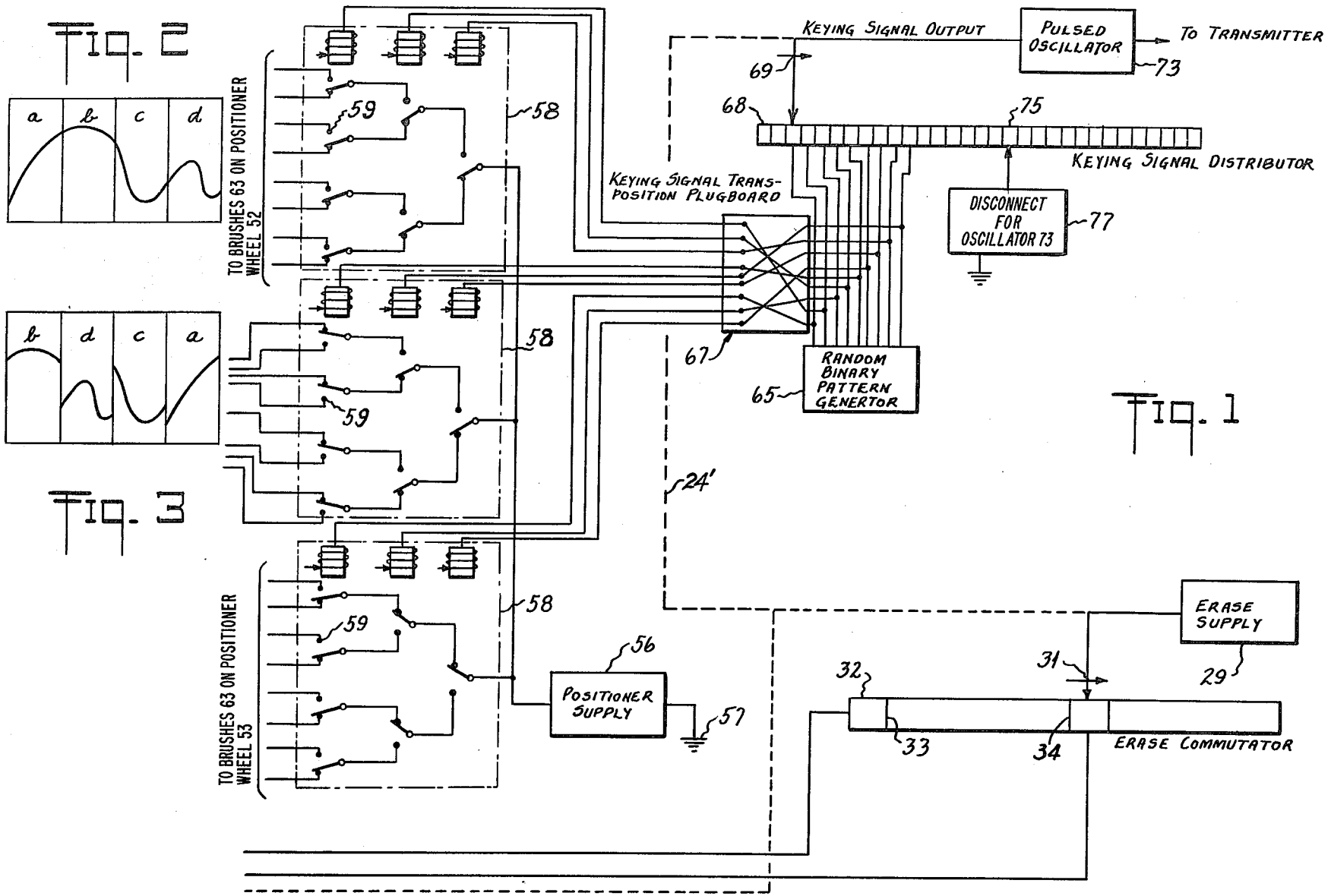

SCRAMBLING COMMUTATOR
I-LEADING
t-TRAILING
SIGNAL DISTRIBUTOR
VOICE WAVE TRAIN
RECORD-PICKUP HEADS
MAGNETIC SECTION 1
DRUM SECTION 2
ERASE HEADS
ERASE HEADS
SYNC DRIVE MOTOR
CLUTCH
GEAR BOX

TUNE DELAY SCRAMBLE EQUIPMENT

This invention relates to time delay scramble equipment and more particularly to time delay scramble equipment such as used in coding.

This equipment may include a random binary pattern generator of the type described in application Ser. No. 405,055, filed Jan. 19, 1954, by Howard L. Daniels for Random Binary Pattern Generator, for the variable selection of the positions of a set of cross-wired wheels that can be of the type described in application Ser. No. 405,056, filed Jan. 19, 1954, by Walter L. Anderson and Howard L. Daniels for Variable Cross-Wired Wheels.

Time delay scramble equipment is useful in coding and operates upon the principle of dividing an output audio signal into consecutive time segments till a preselected number of segments is had and then scrambling those audio signal segments in a random fashion for transmission to a distant receiver. The scrambled audio signal if intercepted by an unauthorized person is completely unintelligible to that person. Though cross-wired wheels have been used in prior coding equipment operating on the time delay scramble principle, such prior coding equipment generally relied upon either manual changes in the cross-wired wheel position or complete changes of the cross-wired wheels in the equipment.

This invention marks a departure from the prior art in that it is directed to a time delay scramble equipment which operates with increased security and according to an arrangement whereby it precludes cutoff of transmission of the coded audio signal during the period that the audio signal is scrambled. To accomplish this purpose two separate magnetic drums are employed each of which include a plurality of adjacent recording tracks. As the audio signal is being recorded on one magnetic drum the other of the magnetic drums is being played back for scrambling and subsequent transmission to a receiver. The two magnetic drums are alternately operable for recording. During the period that one drum is recording the other drum is playing back. Erasure of recorded information on a drum just precedes recording on that particular drum. A series of pairs of cross-wired wheels, the cross-wired wheels of each pair mechanically connected in tandem, comprise circuit components in series circuit with the respective pickup heads for the plurality of tracks of the magnetic drums. The sets of cross-wired wheels in circuit with the pickup heads for each magnetic drum are rotationally positioned under the control of above-mentioned random binary pattern generator so that no previous knowledge of the settings of the cross-wired wheels during any transmission period is in existence. In the time delay scramble system of this invention provision is made for dividing the input audio signal into consecutive 0.1 second segments. It is to be noted that the choice of 0.1 second is not intended in a limiting sense. It is selected as a satisfactory operating condition for the equipment. It represents an acceptable compromise between technical difficulties in coding too small segments on the one hand and allowing intelligible audio in too large time segments to be transmitted on the other hand.

An object of this invention is to provide an improved time delay scramble system.

A further object is to provide an improved time delay scramble system wherein the scrambling scheme may be randomly changed to an unpredictable new scrambling scheme.

A further object is to provide a time delay scramble system wherein there is no need for terminating transmission while the audio signal is being scrambled.

A further object is to provide an improved time delay scramble system wherein the scrambled output audio signal is made available for continuous transmission to a receiver.

A further object is to provide a time delay scramble system wherein the audio signal is randomly scrambled and then further scrambled according to a fixed scrambling scheme to preclude the transmission of any intelligible segments of the original input audio signal.

A further object is to provide a time delay scramble system of such form that an unauthorized interceptor may not recover the settings of the alterable components establishing the scramble key even though he may by some means recover the key in use at the moment, or a series of such keys.

Figure 4:
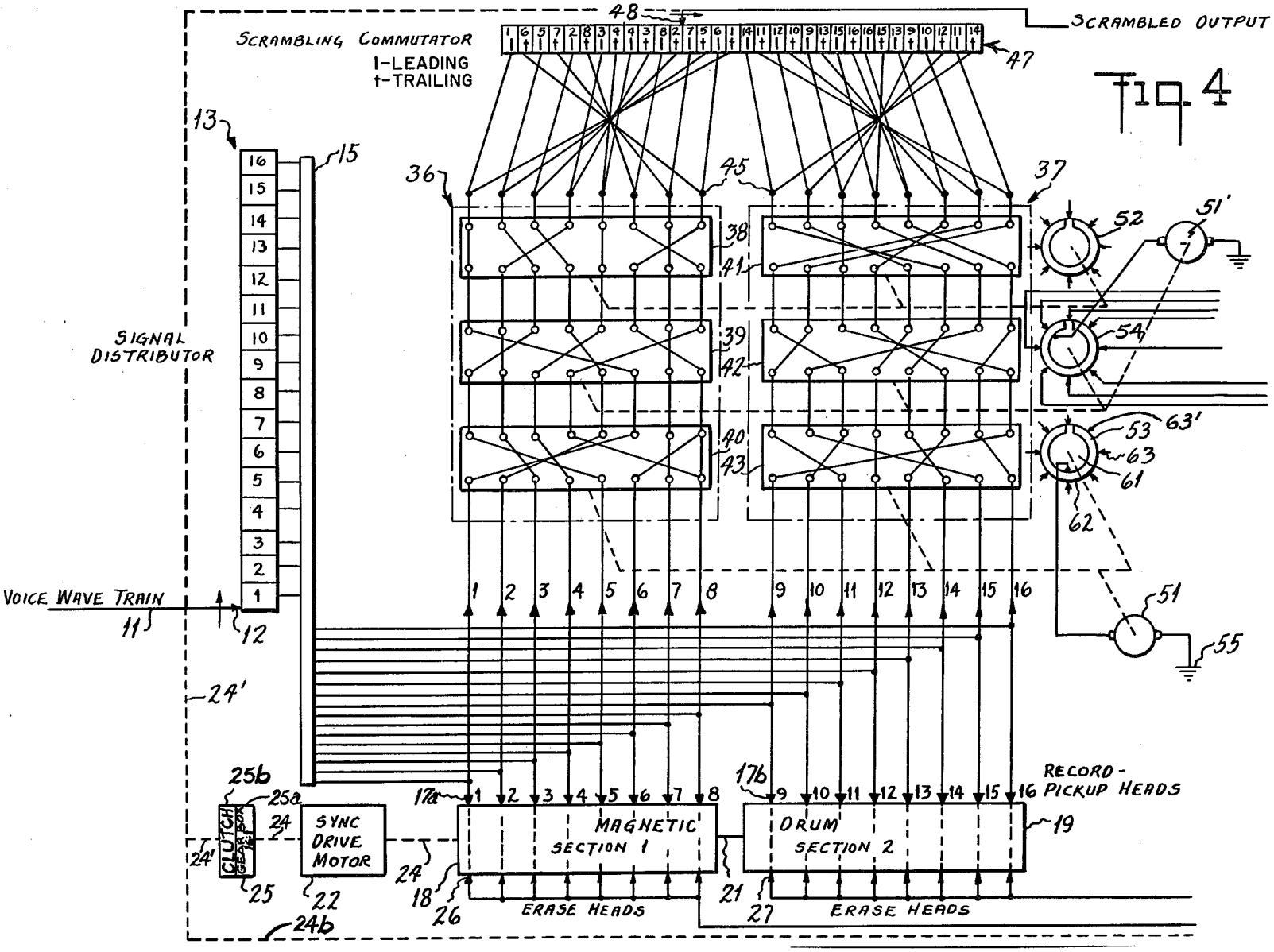

Other objects and many of the attendant advantages of this invention will be readily appreciated as the same becomes better understood by reference to the following detailed description when considered in connection with the accompanying drawings wherein:

FIG. 1 composite with FIG. 4 is a schematic layout of a preferred embodiment of the time delay scramble system of this invention, FIG. 2 is a simplified graphical showing of the wave form of an input audio signal extending over a short period, wherein the number of cycles are reduced for clarity and FIG. 3 is a graphical showing of the same audio signal after it has been delayed and scrambled.

There is shown in FIG. 1 the various basic elements that comprise this time delay scramble system. The audio signal to be coded is fed into the system by means of a conductor 11. The conductor 11 is electrically connected to a brush 12 moving at a constant speed. The brush 12 rotates and thereby moves into and out of electrical engagement with the plurality of segments of circular commutator 13. The commutator 13 and brush 12 forms a signal distributor. The commutator 13 is illustrated on the drawing in developed form. For the purposes of this description a commutator 13 consisting of sixteen segments is selected. Commutators having greater and lesser numbers of segments may be readily adapted to the system herein described. The brush 12 traverses each commutator segment in 0.1 second. The brush 12 completes a cycle one revolution around the commutator every 1.6 seconds. The input audio signal to the system is thereby linearly divided into 0.1 second time segments. Consecutive 0.1 second intervals of an input audio signal is fed to consecutive commutator segments of commutator 13. The time during which the brush 12 remains in contact with any one of the commutator segments is necessarily greater than 0.1 second. Additional time elapses during which the brush is still engaged with the same commutator segment in switching between commutator segments. To prevent too much loss of the original input audio signal because of overlap, the time spent in transition of the brush 12 between two commutator segments 13 is necessarily extremely small.

A cable 15 comprising sixteen leads connect each one of the commutator segments to corresponding ones of sixteen record-pickup heads **17*a* and 17*b*. The record pick-up heads 17*a* and 17*b* are divided into two equal groups. Each of the record-pickup heads in the group 17***a* are associated with a magnetic drum 18 and correspondingly, each of the record-pickup heads in the group 17*b* are associated with a magnetic drum 19. The magnetic drums 18 and 19 are fixedly joined to one another by a suitable connecting means 21. A synchronous driving motor 22 having a drive shaft 24 that rotates at 600 RPM is drivingly connected to the two magnetic drums 18 and 19. A combined clutch and gear box 25 is connected on one side to the shaft 24 and on the other side to a shaft 24'. The ratio of gear box 25*a* is 16:1 so that for every revolution of the brush 12 there are 16 revolutions of the magnetic drums 18 and 19. At 600 RPM the magnetic drums 18 and 19 complete a revolution every 0.1 second. Assuming that the magnetic drums are set to an initial starting position and that the brush 12 is set to an initial starting position at the beginning of a particular commutator segment on the commutator 13 by releasing clutch 25*b*, the input audio signal to the system records on consecutive spaced circular recording tracks of the magnetic drums 18 and 19. For example during the first tenth of a second of the speech input to the system following start of operation, the brush 12 traverses the first commutator segment of the commutator 13 in its path. During this time the input audio signal to the system records around the particular track associated with said commutator segment through one of the recording heads in group 17*a*. Since the magnetic drums make a complete revolution every 0.1 second, every 0.1 second interval of the input audio signal is recorded upon one complete circular track of the magnetic drums.

Diammetrically opposite to each of the record-pickup heads in groups 17*a* and 17*b* there is provided an erasing head. The sixteen erasing heads 26, 27 corresponding to the sixteen record-pickup heads 17*a*, 17*b* are divided into two groups corresponding to the groups of the record-pickup heads. The group 26 of the erasing heads corresponds to the group 17*a* of the record-pickup heads and correspondingly the group 27 of the erasing heads corresponds to the group 17*b* of the record-pickup heads. The erasing heads in each group 26 and 27 are electrically connected in common so that every erasing head in either group 26 or group 27 is energized at exactly the same time.

Each of the groups 26 and 27 of erasing heads are arranged to be energized from a common erasing supply 29. A brush 31 electrically connected to the erasing supply 29 is rotated at the same speed as the brush 12 by mechanical connection to brush 12. The brush 31 is in sliding engagement with commutator 32. Commutator 32 is of the same diameter as commutator 13 but has only two active commutator segments 33 and 34 instead of the sixteen commutator segments on the commutator 13. The brush 31 sweeps across each of the commutator segments 33, 34 in 0.1 second. Since the drums 18 and 19 complete a revolution every 0.1 second the erasing supply 29 is arranged to energize either the group of erasing heads 26 or the group of erasing heads 27 for just so long as is necessary to completely erase all the circular tracks on either magnetic drum 18 or magnetic drum 19. To illustrate, the relative angular relationship of brushes 12 and 31 is such that when the brush 12 arrives at the beginning of an arbitrarily selected initial commutator segment which on the drawing is the first segment at the bottom of the commutator 13, the brush 31 is exactly in the center of the commutator segment 34 of the commutator 32. Since the brush 31 is sweeping to the right the group of erasing heads 26 has been energized by the erasing supply 29 for a time corresponding to half a revolution of the drums 18 and 19. As the input audio signal is applied to the first segment of commutator 13 the leading edge of the half of the magnetic drum that has been erased comes under the recording heads of the group 17*a*. During the succeeding half of the revolution of the drums 18 and 19 the brush 12 sweeps half way across the first commutator segment. The erasing supply 29 continues to energize the group 26 of erasing heads during this succeeding half revolution of the drums 18 and 19. At the end of the succeeding half revolution the brush 31 will have swept across the entire commutator segment 34 and the electrical connection between the erasing supply 29 and the group 26 of erasing heads is terminated. Erasure of magnetic drum 18 is complete. At precisely the same time the input audio signal begins to record on the aforementioned succeeding half of the first track on the drum 18. There is no delay introduced through erasure of information from the drums. The input audio signal is recorded continuously onto the consecutive magnetic tracks of drums 18 and 19 and erasure begins to take place just 0.05 second prior to the time that recording is to begin on a magnetic drum.

The instant at which erasure begins is critical. Just prior to the time that erasure of cylinder 18 is commenced, the input audio signal is being recorded on the last track of drum 19 and an earlier recorded part of the audio input signal is being picked up for transmission by one of the record-pickup heads 17*a*. When the input audio signal begins to record on the latter 180° of the last circular track to the right of drum 19, the first 180° of the last track of drum 18 has passed its associated pickup head and has been picked off and transmitted and the leading edge of the first 180° of the said last track of drum 18 is aligned with the associated erase head of group 26. The other seven tracks of drum 18 have already been played back; the only recorded information awaiting playback for transmission is that remaining on the latter 180° of the last track of drum 18 to be played back. The following three actions occur simultaneously. The input audio signal begins to record on the latter 180° of the last track on the right of drum 19. The latter 180° of the last track of drum 18 being played back for transmission begins to pass the associated pickup head. All the erase heads of group 26 are energized and begin to erase all recorded information on the eight tracks of drum 18 including that recorded on the first 180° of the last track to be picked up for transmission. Precisely 0.05 second or one-half revolution of the magnetic drums 18, 19 later, the pickup for transmission from drum 18 is terminated; the recording on the last track of drum 19 is complete; the erase heads remain energized for 0.05 seconds longer to erase the latter 180° of all the tracks of drum 18; recording begins on the first track on the left of drum 18. With the positioning of the record-pickup heads and the erase heads 180° apart, if era ure were to begin sooner than indicated above some of the recorded information would be erased without being transmitted. If erasure were to begin later than indicated above there would be an overlap of recorded information on one track. By operating as described above no information is lost and operation is continuous.

A set of cross-wired wheels is connected in circuit with each group of record-pickup heads 17*a* and 17*b*. The set 36 of the cross-wired wheels 38, 39 and 40, which wheels are electrically connected in tandem, are electrically connected to the group 17*a* of the record-pickup heads. Correspondingly the set 37 of cross-wired wheels including three separate cross-wired wheels 41, 42 and 43 electrically connected in tandem are electrically connected to the group 17*b* of record-pickup heads. The sets 36 and 37 of the cross-wired wheels are each shown in flat developed form. FIG. 1 only illustrates schematically the electrical relationship of the various cross-wired wheels but does not purport to show physical relationships of the cross-wired wheels. Each record-pickup head of each of the groups 17*a* and 17*b* is connected to one only of the terminals 45 of the sets 36 and 37 of the cross-wired wheels. However, because of the scrambled wiring in the cross-wired wheels of each set, there is no spatial relationship between the record-pickup heads in the groups 17*a*, 17*b* and the terminals 45 to which the record-pickup heads are electrically connected. The cross-wired wheels serve the function of scrambling the individual 0.1 second segments of input audio signal.

A commutator 47 having thirty-two commutator segments is electrically connected with the sets 36 and 37 of cross-wired wheels. A brush 48 mechanically connected with brushes 12 and 31 sweeps across commutator 47. The diameter of commutator 47 is equal to the diameters of commutator 13 and commutator 32 in the embodiment illustrated herein. The brush 48 sweeps across the commutator 47 at the same speed as does the brush 12 and brush 31 in sweeping across commutator 13 and commutator 32, respectively. Therefore the brush 48 sweeps across two segments in the time it takes either the brush 12 or the brush 31 to sweep across one commutator segment. Twice as many segments in commutator 47 provides for extra security in preventing any intelligible segments of the input audio signal from being transmitted. Each of the terminals 45 is connected to two spaced segments, namely an l segment and a t segment of the commutator 47, corresponding to leading and trailing halves respectively of the tracks on magnetic drums 18 and 19 thereby splitting each 0.1 second segment of the signal into two spaced 0.05 segments.

It is important that the spacing between two commutator segments that are connected to the same terminal 45 be spaced a distance covered by an even number of segments of commutator 47 for reasons which will become evident as the description proceeds. Since each 0.1 second segment of the input audio signal is now split in two and displaced, the fractional segments of the audio signal picked up by the brush 48 will be unintelligible even though portions of the scrambled output from the sets of cross-wired wheels may be insufficiently scrambled. The brush 48 is set at a position that is displaced 180° relative to brush 12. Therefore while part of the input audio signal is being recorded on the magnetic drum 18 an earlier part of the input audio signal is being picked off the drum 19, scrambled in the set 37 of the cross-wired wheels, further scrambled through the expedient of connecting each of the terminals 45 to two commutator spaced segments of the commutator 47, and then transmitted after being picked up by the brush 48 sweeping across the segments of the commutator 47. Therefore while part of the input audio signal is being recorded on one of the magnetic drums, an earlier part of the same audio signal is being picked off the other of the magnetic drums and transmitted as scrambled output.

By using the elements described it is possible to scramble an input audio signal according to a cyclic pattern that repeats every 1.6 seconds. However if the same cyclic pattern is used always or even for a substantial length of time the coding is of doubtful value. To overcome this problem additional means are included in this system for changing the cyclic pattern everytime the push button on the microphone of the transmitter, not shown, is pressed. Depressing the button on the microphone, not shown, initiates a sequence of circuit operations that result in rotation of each of the cross-wired wheels in each of the sets 36 and 37 as will be subsequently described.

Three drive motors, only two of which are shown at 51 and 51' are provided for rotating the cross-wired wheels 38 through 43 and positioner wheels 52, 53, and 54. The drive motor 51 is drivingly connected to the cross-wired wheels 40 and 43 and the positioner wheel 53, to rotate them together. Correspondingly the two other motors, only one of which is shown, are provided for accomplishing the same purpose with respect to the other cross-wired wheels. One side of the motor 51, taken as illustrative for the other two motors, is grounded at 55. The other side of the motor 51, electrically connected to positioner wheel 53, is adapted to be connected to positioner supply 56 which is likewise grounded at 57. The circuit from the positioner supply 56 to the three motors is arranged to be completed through the action of three sets of relay controlled contacts connected in a christmas-tree fashion. The three sets of relays 58 each comprise three relays; in each case, the relay to the right has one contactor, the intermediate relay has two contactors and the relay to the left has four contactors, which are arranged to connect the positioner supply 56 to any one and only one of eight terminals 59. This is true in the case of each of the three relay sets 58. Each of the relay sets 58 are in electric circuit relationship with a positioner wheel.

In operation the positioner wheel 53 is operatively connected to the output terminals 59 of the lower relay set 58. Eight equally spaced brushes 63 bear against the surface of each positioner wheel. The eight brushes of each positioner wheel are connected to corresponding eight terminals 59 of the relay set with which it is associated. The eight brushes of the positioner wheel 53 are connected to the eight terminals 59 of the lower relay set 58. Depending upon the particular combination of energized and deenergized coils in the lower relay set 58 a particular one of the brushes bearing against positioner wheel 53 will be connected in series circuit with the positioner supply 56.

Each positioner wheel comprises a central insulating portion 61 and an interrupted peripheral conducting ring 62. The space defining the interruption in ring 62 is filled by a projection on the central insulating portion 61. The positioner wheels function in a manner analogous to commutators. The peripheral surface of the positioner wheels, in each case, is $\frac{7}{8}$ conducting and $\frac{1}{8}$ insulating. When the brush connected in series circuit with the positioner supply by means previously described is bearing against the conducting portion of the surface of the associated positioner ring, a circuit is completed including the positioner supply and the motor associated with that particular positioner wheel. The associated motor rotates. For example, assuming that the brush 63' on the positioner wheel 53 is connected in series circuit with the positioner supply 56 through the action of lower relay set 58, the motor 51 rotates since it is now connected in circuit with the positioner supply 56 through its electrical connection to the conducting ring 62 of positioner wheel 53. The motor 51 will continue to rotate until the peripheral insulating portion of the positioner wheel 53 comes under the brush 63'. At that time the circuit including the motor 51 and the positioner supply 56 is broken and the motor 51 stops. It is by this means that the cross-wired wheels in each of the two sets 36 and 37 are rotated to their different positions.

The security of the scramble key is thus enhanced because there is no necessity to publish the cross-wired wheel settings in advance. The wheel settings are automatically and randomly determined by the random binary pattern generator 65 when the talk button on the microphone, not shown, is initially depressed. This portion of the circuit operation is accomplished by the Random Binary Pattern Generator invented by Howard L. Daniels, Ser. No. 405,055, Filed Jan. 19, 1954. When the talk button, not shown, is initially depressed the two electromagnets of the random binary pattern generator described in the above patent application are energized setting up a random circuit arrangement. Because of the random nature of the resulting circuit arrangement there is no possibility of anyone knowing it in advance. The electromagnets of the random binary pattern generator remain energized for so long as the talk button remains depressed. However when the talk button is released the electromagnets of the random binary pattern generator 65 are deenergized opening all the energizing circuits of the relays in the relay sets 58 whereby all the contactors in said relay sets return to their normal unactuated position. It is at this time that a preselected one of the brushes on each of the positioner wheels is connected in circuit with the positioner supply 56. If the particular brush which is now connected to the positioner supply is not bearing against the insulating portion of the associated positioner wheel, the associated motor begins to rotate driving the positioner wheels and the cross-wired wheels until the insulating portions of the associated positioner wheel comes under the said brushes. By this arrangement the positioner wheels and their associated cross-wired wheels are returned to an initial starting position.

For further security in connection with the use of the random binary pattern generator 65 keying signal transposition plugboard 67 is provided for changing the electrical connections of the nine relays in the sets 58 to the switches of the random binary signal generator 65. The settings of the plugs in the plugboard 67 in both the transmitting and receiving apparatus are necessarily arranged according to a known pattern.

A commutator 68 is provided for transferring the information on the random circuit arrangement set up by the random binary pattern generator 65 to the receiving equipment whereby the cross-wired wheels in the receiving equipment are set corresponding to the positions of the cross-wired wheels of the transmitter. The commutator 68 has the same dimensions and the same number of commutator segments as does the commutator 47. Its brush 69 is mechanically connected to the other brushes 12, 31, and 48 and rotates at the same speed as the other brushes. The brushes are coupled to the driving motor 22 through a magnetic clutch **25*b*. Nine adjacent segments of the commutator 68 are connected to the nine switches of the random binary pattern generator 65 discussed above. Assuming that the receiving equipment includes the time delay scramble system of the same character described herein the information as to which of the switches in the random binary pattern generator 65 is open or closed is transferred to the receiving equipment by means of the brush 69 sweeping across the commutator 68. To accomplish this purpose an oscillator 73 is connected with the brush 69 whereby it produces an output when the brush 69 sweeps across the commutator segment of the commutator 68 which is in circuit with a closed switch of the random binary pattern generator 65. Therefore as the brush 69 sweeps across the commutator 68 initially after the talk button has been pressed it sends out a series of tone signals to the receiver which are utilized for closing the proper relays that corresponds with the closed relays in the sets of relays 58. By this means the cross-wired wheels in the receiving equipment is set to the same position as the cross-wired wheels of the time delay scramble system in the transmitting equipment. One of the subsequent commutator segments 75 of the commutator 68 is connected to means 77 which is adapted to disconnect the oscillator 73 when the brush 69** sweeps across that particular commutator segment. It is by this means that the tone signals are only sent out during the initial part of the first cycle after the talk button is pressed for the purpose of synchronizing the time delay scramble system in both the transmitting and receiving equipment.

All the commutators and their associated brushes are accurately formed; transfer time of any brush from one commutator segment to the next is minimal.

The magnetic clutch **25*b* comprises two coils. Energizing the coil couples the commutator system to a shaft rotating at synchronous speed. Energizing the other brakes the system to a stop. For the case of a radio link, keying on the carrier to start communication energizes the "run" coil. Following disappearance of the carrier, the brush system halts on reaching a "home" position. For direct wire communication an additional wire may be used for control purposes. The "home" position is that position in which the brush 69 is on the left-most segment of the commutator 68** in the transmitter and in the associated receiver. When the circuit is opened (microphone button is released) the commutator system continues to rotate until it reaches "home" at which point it is halted by operation of the clutch. When the circuit is closed (microphone button is pressed) for the next communication, the commutators of both the transmitting and receiving equipments are clutched to the rotational source simultaneously so as to remain in step.

Obviously many modifications and variations of the present invention are possible in the light of the above teachings. It is therefore to be understood that within the scope of the appended claims the invention may be practiced otherwise than as specifically described.

I claim:

1. A time-delay scramble equipment comprising, a drive motor, a combined input commutator element and brush element, one of said input elements being mechanically coupled to said motor, said input commutator element having a predetermined number of conducting segments, a magnetic recoring drum mechanically coupled to said drive motor, said recording drum including two attached sections for rotation together, each section of said recording drum having a plurality of axially spaced recording tracks, the number of tracks on each section of said recording drum being one-half of said predetermined number of input commutator segments, a plurality of aligned record-pickup heads, the number of record-pickup heads being equal to the number of recording tracks on said recording drum, one of said record-pickup heads being disposed at each recording track, electrical means connecting in sequence said input commutator element segments to respective ones of said record-pickup heads, a corresponding plurality of aligned erase heads one at each track and angularly spaced 180 degrees from said record-pickup heads, an erase supply, a combined erase commutator element and brush element, one of said erase elements being-mechanically coupled to said motor, said erase brush element being connected to said erase supply, said erase commutator element having to conducting segments disposed diametrically each of the aparts, segments of said erase commutator being electrically connected to all of the erase heads associated with a respective recording drum section, a cross-wired wheel for each recording drum section, each of said cross-wired wheels having the same number of connections as there are record-pickup heads associated with the respective recording drum section, electrical means connecting the record-pickup heads associated with each recording drum section with a corresponding cross-wired wheel, a combined output commutator element and brush element, one of said output elements being mechanically coupled said motor, said output commutator element comprising two adjacent arcuate sections, each section having a number of segments comprising twice the number of connection of each of said cross-wired wheels, electrical means connecting each cross-wired wheel to a respective section of said output commutator with each connection of each cross-wired wheel being connected to two output commutator segments, that are an even number of segments apart, said motor driving each of said elements mechanically coupled thereto at the same angular velocity, a positioner wheel mechanically coupled to each of said cross-wired wheels, each of, said positioner wheels including a conducting ring formed with a single interruption, a plurality of brushes for each positioner wheel equal to the number of connections in each cross-wired wheel and spaced at angular intervals about said rings respectively, a positioner supply, a positioner wheel motor connected in series between said positioner supply and said rings and mechanically coupled to said positioner wheels, relay switch means for each of said positioner wheels, each of said relay switch means electrically coupled to the brushes of the respective positioner wheel and to said positioner supply for connecting one brush associated with each positioner wheel to said positioner supply and a random binary pattern generator coupled to said relay switch means for controlling the operation of said relay switch means to select at random for energization the one brush associated with each of said positioner wheels for controlling random angular positioning of the respective cross-wired wheels.

2. A time-delay scramble equipment, said scramble equipment comprising, a driven motor, a combined input commutator element and brush element one of said elements being mechanically coupled to said motor, said commutator element having a predetermined number of segments, a magnetic recording drum driven by said drive motor, said drum comprising a plurality of sections adapted for rotation together, each section having a plurality of axially spaced recording tracks, the number of tracks on each section of the drum being a fraction of said predetermined number of input commutator segments, a plurality of record-pickup heads, the number of record-pickup heads being equal to the number of tracks on the drum, one of said record-pickup heads being disposed at each track, electrical means connecting said input commutator element segments and said record-pickup heads, a corresponding plurality of erase heads one at each track and angularly spaced 180 degrees from the record-pickup heads, an erase brush connected to a suitable erase supply, a combined erase commutator element and brush element one of said elements driven by said motor, said commutator element having a plurality of conducting segments disposed angularly apart, said different segments being electrically connected to the erase heads associated with different drum sections, a plurality of cross-wired wheels, each of the cross-wired wheels having the same number of input and output connections as there are record-pickup heads for a corresponding magnetic drum section, electrical means connecting the record-pickup heads from each drum section with a corresponding cross-wired wheel, a combined output commutator element and brush element, one of said elements being driven by said motor, said commutator element comprising a plurality of sections, each section having a total number of segments comprising twice the number of outputs at the corresponding cross-wired wheel, each output connection of the corresponding cross-wired wheel being connected to two different commutator segments, said two segments being separated from each other, electrical means connecting each cross-wired wheel with a corresponding output commutator section.

3. A time-delay scramble equipment, said scramble equipment comprising, a drive motor, a combined input commutator element and brush element, one of said elements being mechanically coupled to said motor, said commutator element having a predetermined number of segments, a magnetic recording drum driven by said drive motor, said drum comprising a plurality of sections adapted for rotation together, each section having a plurality of axially spaced recording tracks, the number of tracks on each section of the drum being a fraction of said predetermined number of input commutator segments, a plurality of record-pickup heads, the number of record-pickup heads being equal to the number of tracks on the drum, one of said record-pickup heads being disposed at each track, electrical means connecting said input commutator element segments and said record-pickup heads, a corresponding plurality of erase heads one at each track and angularly spaced 180 degrees from the record-pickup heads, an erase brush connected to a suitable erase supply, a combined erase commutator element and brush element one of said elements driven by said motor, said commutator element having a plurality of conducting segments disposed angularly apart, said different segments being electrically connected to the erase heads associated with different drum sections, a plurality of cross-wired wheels, each of the cross-wired wheels having the same number of input and output connections as there are record-pickup heads for a corresponding magnetic drum section, electrical means connecting the record-pickup heads from each drum section with a corresponding cross-wired wheel, a combined output commutator element and brush element, one of said elements being driven by said motor, said commutator element comprising a plurality of sections, each sections having a total number of segments comprising twice the number of outputs at the corresponding cross-wired wheel, each output connection of the corresponding cross-wired wheel, each output connection of the corresponding cross-wired wheel being connected to two different commutator segments, said two segments being separated from each other, electrical means connecting each cross-wired wheel with a corresponding output commutator section, a positioner wheel coupled to each cross-wired wheel, said positioner wheel having the same number of angular positions as there are record-pickup heads at a recording magnetic drum section, said positioner ring comprising a single-interruption ring, an equal number of brushes at angular intervals about said ring, and means to provide random positioning of said positioner wheel.

4. A time-delay scramble equipment comprising, a drive motor, a combined input commutator element and brush element, one of said input elements being mechanically coupled to said motor, said input commutator element having a predetermined number of conducting segments, a magnetic recording drum mechanically coupled to said drive motor, said recording drum including a plurality of attached sections for rotation together, each section of said recording drum having a plurality of axially spaced recording tracks, the number of tracks on each section of said recording drum being a fraction of said predetermined number of input commutator segments which fraction is equal to the reciprocal of the number of sections of said recording drum, a plurality of aligned record-pickup heads, the number of record-pickup heads being equal to the number of tracks on said recording drum, one of said record-pickup heads being disposed at each track, electrical means connecting said input commutator element segments and said record-pickup heads respectively, a corresponding plurality of aligned erase heads one at each track and angularly spaced 180 degrees from said record-pickup heads, an erase supply, a combined erase commutator element and brush element, one of said erase elements being mechanically coupled to said motor, said erase brush element being connected to said erase supply, said erase commutator element having a plurality of conducting segments equal to the number of sections of said recording drum and disposed equiangularly apart, each of the segments of said erase commutator being electrically connected to all of the erase heads associated with a respective recording drum section, a plurality of cross-wired wheels equal to the number of sections on said recording drum, each of said cross-wired wheels having the same number of connections as there are record-pickup heads for each section of said recording drum, electrical means connecting the record-pickup heads associated with each recording drum section with a corresponding cross-wired wheel, a combined output commutator element and brush element, one of said output elements being mechanically coupled to said motor, said output commutator element comprising a plurality of adjacent arcuate sections equal to the number of sections of said drum, each section having a number of segments equal to twice the number of connections of each of said cross-wired wheels, and electrical means connecting each cross-wired wheel to a respective section of said output commutator with each connection of said cross-wired wheel being connected to two output commutator segments that are spaced an even number of segments apart, said motor driving each of said elements mechanically coupled thereto at the same angular velocity.

5. A time-delay scramble equipment comprising, a drive motor, a combined input commutator element and brush element, one of said input elements being mechanically coupled to said motor, said input commutator element having a predetermined number of conducting segments, a magnetic recording drum mechanically coupled to said drive motor, said recording drum including a plurality of attached sections for rotation together, each section of said recording drum having a plurality of axially spaced recording tracks, the number of tracks on each section of said recording drum being a fraction of said predetermined number of input commutator segments which fraction is equal to the reciprocal of the number of sections of said recording drum, a plurality of aligned record-pickup heads, the number of said record-pickup heads being equal to the number of tracks on said recording drum, one of said record-pickup heads being disposed at each recording track, electrical means connecting said input commutator element segments and said record-pickup heads respectively, a corresponding plurality of aligned erase heads one at each track and angularly spaced 180 degrees from said record-pickup heads, an erase supply, a combined erase commutator element and brush element, one of said erase elements being mechanically coupled to said motor, said erase brush element being connected to said erase supply, said erase commutator element having a plurality of conducting segments equal to the number of sections of said recording drum and disposed equiangularly apart, each of the segments of said erase commutator being electrically connected to all of the erase heads associated with a respective recording drum section, a plurality of cross-wired wheels equal to the number of sections of said recording drum, each of said cross-wired wheels having the same number of connections as there are record-pickup heads associated with each section of said recording drum, electrical means connecting the record-pickup heads associated with each recording drum section with a corresponding cross-wired wheel, a combined output commutator element and brush element, one of said output elements being mechanically coupled to said motor, said output commutator element comprising a plurality of adjacent arcuate sections equal to the number of sections of said drum, each section having a number of segments equal to twice the number of connections of each of said cross-wired wheels, electrical means connecting each cross-wired wheel to a respective section of said output commutator with each connection of each cross-wired wheel being electrically connected to two output commutator segments that are an even number of segments apart, said motor driving each of said elements mechanically coupled thereto at the same angular velocity, a positioner wheel mechanically coupled to at least one of said cross-wired wheels, said positioner wheel including a conducting ring formed with a single interruption, a plurality of brushes equal to the number of connections in each cross-wired wheel and spaced at equiangular intervals about said ring, electrical drive means mechanically coupled to said positioner wheel, and means electrically connecting said drive means at random in series with one bruch associated with said last-mentioned positioner wheel and said ring whereby said drive means rotates said positioner wheel until said one brush comes into registration with the interruption in said ring.

6. Apparatus for continuously scrambling an input signal and continuously transmitting the scrambled signal, said apparatus comprising a device for dividing an input signal into equal time segments, said device having a single input and a plurality of outputs and electrical means for connecting said input to each of said outputs in sequence continuously and for a predetermined time interval each, a closed magnetic track for each of said outputs, said tracks forming two groups with about the same number of tracks in each group, a record-pickup head and an erase head magnetically engaging continuously each of said tracks respectively, drive means moving said tracks and heads relative to each other whereby all of said tracks are completely traversed by said heads in the time corresponding to one time segment, said record-pickup heads being electrically connected to said outputs respectively whereby sequential time segments of the signal are recorded on the tracks of one group until each of the tracks of the one group have recorded a time segment and then sequential time segments of the signal are recorded on the tracks of the other group, said erase heads being connected in common in two groups corresponding to the two groups of tracks, a conductive channel connected to each of said record-pickup heads respectively and being arranged in two groups corresponding to said groups of tracks, the conductive channels of each group being scrambled, output means electrically engaging said scrambled channels one at a time whereby as time segments of the signal are recorded on one of said groups of tracks, time segments of the signal previously recorded on the other group of tracks are provided by said output means in scrambled sequence, erase head energizing means for energizing one group of said erase heads at a time, to erase the tracks of a group just prior to the time that group begins to record.

* * * * *